US005125304A

United States Patent [19]

Petersen

[11] Patent Number: 5,125,304

[45] Date of Patent: Jun. 30, 1992

[54] CUTTING SYSTEM FOR CUTTING THREE SIDES OF PRINTED PRODUCTS, PARTICULARLY FOLDED PRINTED PRODUCTS

[75] Inventor: Godber Petersen, Augsburg, Fed. Rep. of Germany

[73] Assignee: Man Roland Druckmaschinen AG, Offenbach am Main, Fed. Rep. of Germany

[21] Appl. No.: 581,471

[22] Filed: Sep. 11, 1990

[30] Foreign Application Priority Data

Sep. 19, 1989 [DE] Fed. Rep. of Germany ..... 3931158

[51] Int. Cl.[5] ..... B26D 7/02; B65H 5/02

[52] U.S. Cl. ..... 83/100; 83/404; 83/455; 83/461; 83/934; 83/581.1

[58] Field of Search ..... 83/934, 100, 404, 409.1, 83/409.2, 404.4, 415, 454, 455, 461, 581.1

[56] References Cited

U.S. PATENT DOCUMENTS

| | | | |
|---|---|---|---|
| 2,017,462 | 10/1935 | Kleinberg | 83/934 X |
| 3,146,650 | 9/1964 | Sarring et al. | 83/934 X |
| 3,570,344 | 3/1971 | Bryson et al. | 83/934 X |
| 3,722,336 | 3/1973 | Sarring | 83/934 X |
| 3,733,947 | 5/1973 | Bryson et al. | 83/934 X |
| 4,840,365 | 6/1989 | Kobler et al. | 270/54 |
| 4,871,159 | 10/1989 | Petersen | 270/55 |

FOREIGN PATENT DOCUMENTS

| | | |
|---|---|---|
| 2430043 | 1/1975 | Fed. Rep. of Germany . |
| 3518579 | 11/1986 | Fed. Rep. of Germany . |
| 3613493 | 11/1986 | Fed. Rep. of Germany . |
| 3524512 | 1/1987 | Fed. Rep. of Germany . |
| 3713905 | 11/1987 | Fed. Rep. of Germany . |

*Primary Examiner*—Mark Rosenbaum
*Assistant Examiner*—Kenneth E. Peterson
*Attorney, Agent, or Firm*—Frishauf, Holtz, Goodman & Woodward

[57] ABSTRACT

To trim a plurality of printed products, which may have different thicknesses, first and second cutting assemblies are provided, each cutting assembly having a cutting knife (98, 59) and a cutting counter element (115, 65). The printed products are held in receivers formed of a fixed jaw and a movable jaw, resiliently clamping the printed products between the jaws, the knives being moved across the printed products and against the counter elements. The printed prroducts are supplied to the first cutting assembly by a pair of toothed or ribbed belt (20) from a storage cassette (1). The length dimension to be cut is determined by a stop rail (39) and the width dimension is determined by the spacing of two lateral knives of the second cutting assembly. A transfer apparatus transfers the printed products from the first to the second cutting assembly, from which they can then be removed. The knives are moved in a guide way formed by guide rails on which sliders operate.

15 Claims, 14 Drawing Sheets

CUTTING SYSTEM FOR CUTTING THREE SIDES OF PRINTED PRODUCTS, PARTICULARLY FOLDED PRINTED PRODUCTS

Reference to related patents and applications, the disclosures of which are hereby incorporated by reference, assigned to the assignee of the present application:

U.S. Pat. No. 4,840,365, Kobler and Petersen

U.S. Pat. No. 4,871,159, Petersen

U.S. Ser. No. 07/329,798, filed Mar. 28, 1989, Petersen (which includes the disclosure of German Published Application DE-OS 38 11 289).

Reference to related publications:

| | |
|---|---|
| German Patent Disclosure Document | DE-OS 34 05 877 |
| German Patent Disclosure Document | DE-OS 35 18 579, Gämmerler |
| German Patent Disclosure Document | DE-OS 24 30 043, Rösner et al |
| German Patent Disclosure Document | DE-OS 37 13 905, Schäffer et al |
| German Patent Disclosure Document | DE-OS 25 24 512, Weingartner et al |
| German Patent Disclosure Document | DE-OS 36 13 493, Greif et al. |

FIELD OF THE INVENTION

The present invention relates to a cutting system for cutting three sides of printed produces, and particularly folded printed products, which may be multi-sheet elements, and, especially, to cut a plurality of such printed products in essentially a single cutting operation to cut or trim three sides thereof, typically the side opposite the fold line or bend or crease or back of folded products, and the two lateral sides.

BACKGROUND

German Patent Disclosure Document 36 13 493, Greif et al, describes a cutter system with three knives to provide for triple-sided cuts of books, manuals, magazines and the like. The products to be cut are supplied by an advance supply system which has pincers or grippers to hold the products in a cutting position. At the cutting position, or in a cutting station, the sequentially supplied products to be cut are again retained in holders, for example in grippers systems or at gripper stations. Due to the cutting mechanism used, and the required rotation of the printed products and the serially operating steps, only a low cutting and operating speed of this three-knife cutting machine can be obtained.

Similarly operating machines are also disclosed in German Patent Disclosure Documents DE-OS 35 18 579, Gämmerler, and DE-OS 35 24 512, Weingartner.

THE INVENTION

It is an object to provide a cutting system which makes three-sided cuts of printed products, preferably folded printed products, in which, in a single operating step, a plurality of such products which may have different thicknesses can be cut, without requiring rotation or turning of either the products or the cutting element.

Briefly, the respective folded products are retained in respective individual retention elements, of which a plurality are provided. Each one of the retention elements retain at least one of the products and hold them in the first cutting position in predetermined alignment. A first cutting knife and a first cutting counter element are provided, movably retained and shiftable along a first guide. A first support slide or carrier supports the first cutter knife, and is operatively associated with an operating unit which moves the support slide along the first guide. The first guide is located to guide the cutter past the cutter counter element so that, upon movement of the cutter past the printed products, a first side thereof is cut or trimmed. Typically, the first side will be the one opposite the fold if the printed product is a folded product. A second cutting assembly for cutting the two lateral sides transversely to the first side is provided as part of the system which again includes a plurality of second retention elements for retaining each of the printed products in a second cutting position, while maintaining the predetermined alignment. A transfer system transfers the printed products between the first cutting assembly and the second cutting assembly while maintaining the predetermined alignment of the products, for example by shifting the products transversely to the fold line thereof. A second cutter, a second cutter counter element and a second guide structure, as well as a second support slide or carrier are provided, which all can be similar to the first ones, the second guide, however, being located to guide the second cutter past the second cutter counter structure and, upon being operated, moves the second cutter past the printed products so that the two lateral sides thereof will be cut or trimmed.

The system, thus, permits a plurality of printed products, which may, each, be multi-sheet products and have different thicknesses, to be cut in essentially one operating or cutting operation, in which the first knife of the first cutting assembly cuts parallel to a fold line and the second knives of the second cutting assembly cut the other two sides, the printed products being merely shifted from the cutting path of the first cutter knife to the cutting paths of the two second cutter knives.

The printed products are singly fixed in position in the individual retention elements during cutting. Thus, a clean cut, comparable to a scissor cut, can be obtained. The tension elements and knife counter elements are individually, preferably resiliently adjustable to hold the printed products securely in position while, at the same time, permitting acceptance of products of different thicknesses for a cutting or trimming operation in a single working cycle. In contrast to prior art structures, thus, a substantial increase in the operating speed and through-put of cut products is obtained, coupled with a qualitative improvement of the cut. This improvement is particularly apparent with respect to punch cuts or press cuts made by press cutting machines.

The structure and system of the present invention has the additional advantage that no complex or time-consuming re-adjustment steps must be taken if the format of the printed products to be cut changes. Adjustments are simple and can be carried out rapidly.

DRAWINGS

Figure 1:
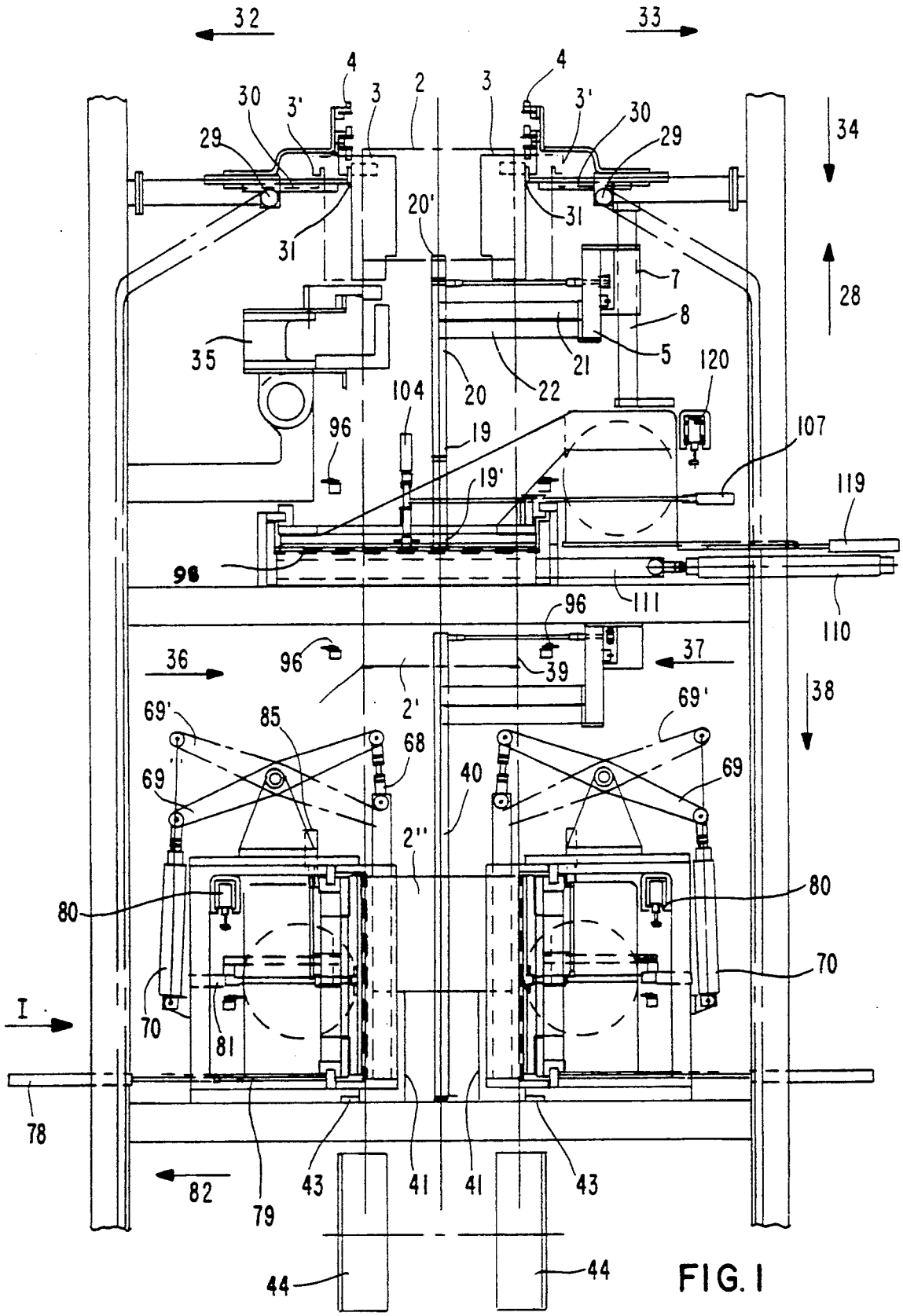
FIG. 1 is a schematic front view of the cutting system of the present invention, omitting elements not necessary for an understanding of the present invention.
Figure 2:
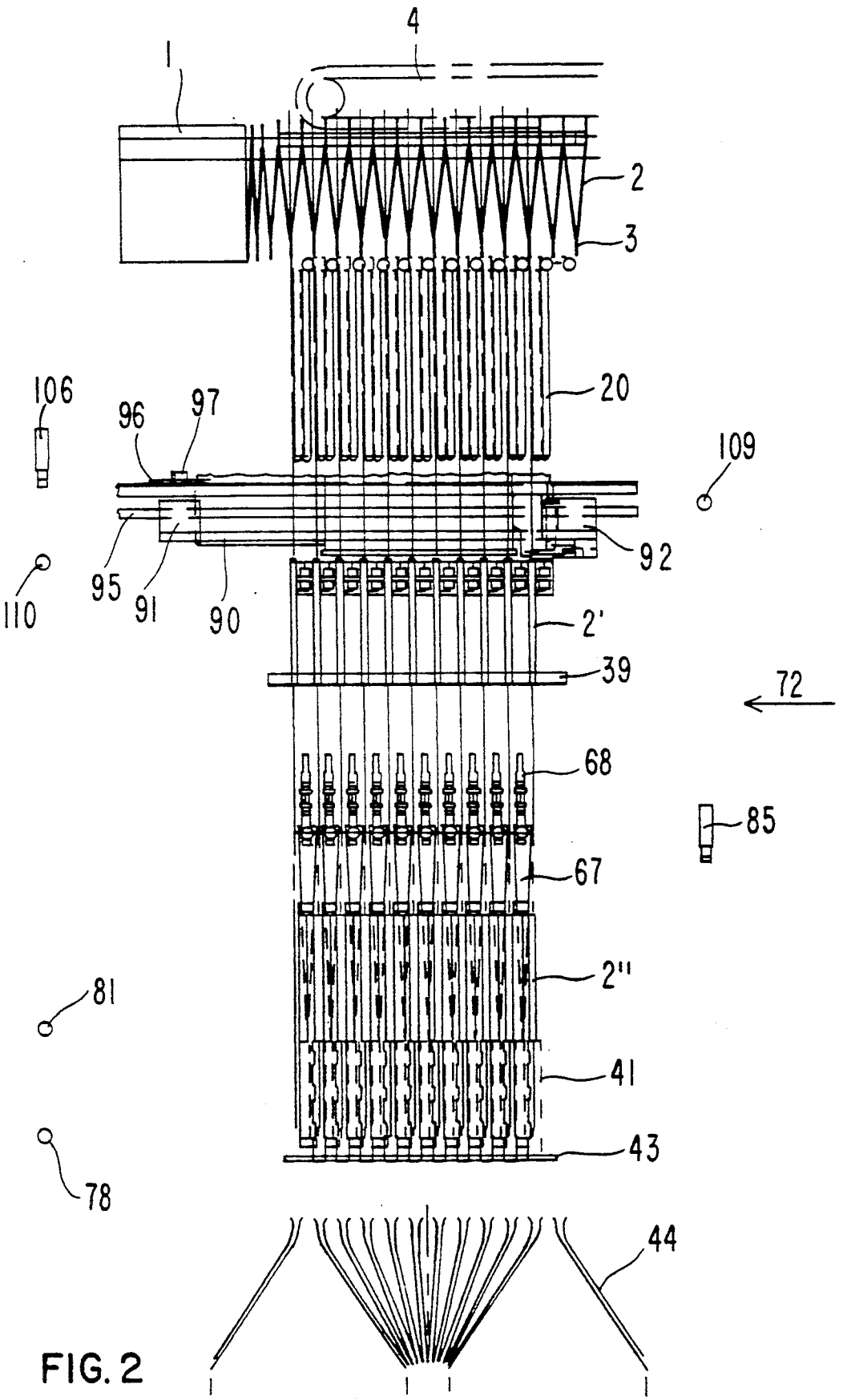
FIG. 2 is a fragmentary detailed side view of the apparatus of FIG. 1, and illustrating its association with a zig-zag type feeding system.

DETAILED DESCRIPTION, with reference to FIGS. 1 and 2

A cassette system 1 simultanteously, that is, in parallel, supplies the printed products 2 which ought to be cut or trimmed. The printed products 2 are held in a zig-zag storage means shown as the storage system 3 and taken out of the storage system by a continuously operating drive. The zig-zag storage structures and systems, and removal of products therefrom are known, and described in the referenced U.S. Pat. No. 4,840,365, Kobler and Petersen. U.S. Pat. No. 4,871,159, Petersen, in detail describes how printed products can be removed from such a storage structure 3 . Simultaneous removal of a plurality of printed products 2 from the storage structure 3 is possible, so that they can be supplied to the cutting system, in accordance with the present invention, simultaneously and in loosely stacked arrangement. The printed products 2 are gripped, separately, by a transport system which will be described in detail in connection with FIGS. 3–5. For convenience, these storage means are referred herein and in the claims as "zig-zag storage means.

Figure 4:
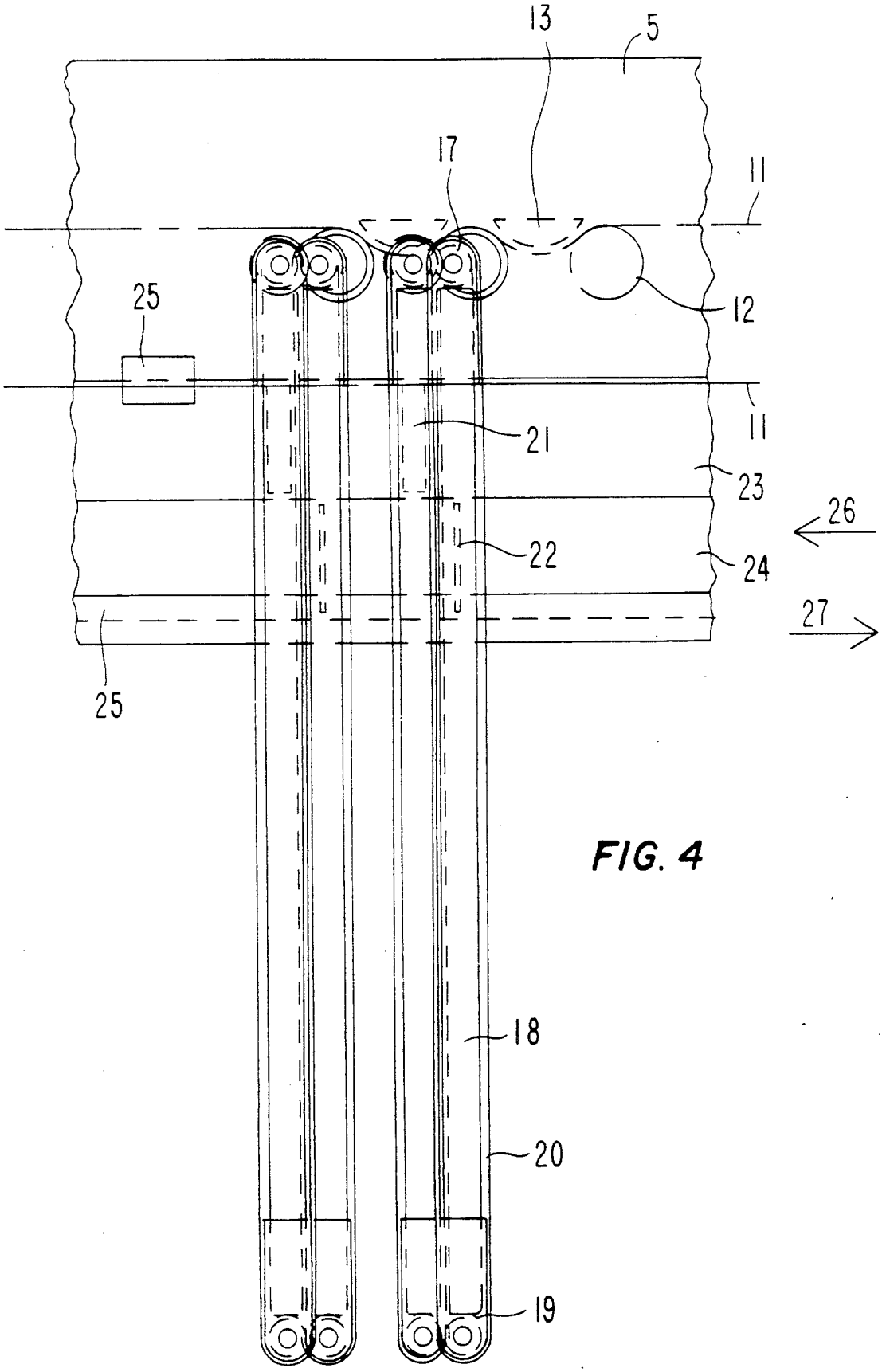
FIG. 4 is a side view of FIG. 3.
Figure 5:
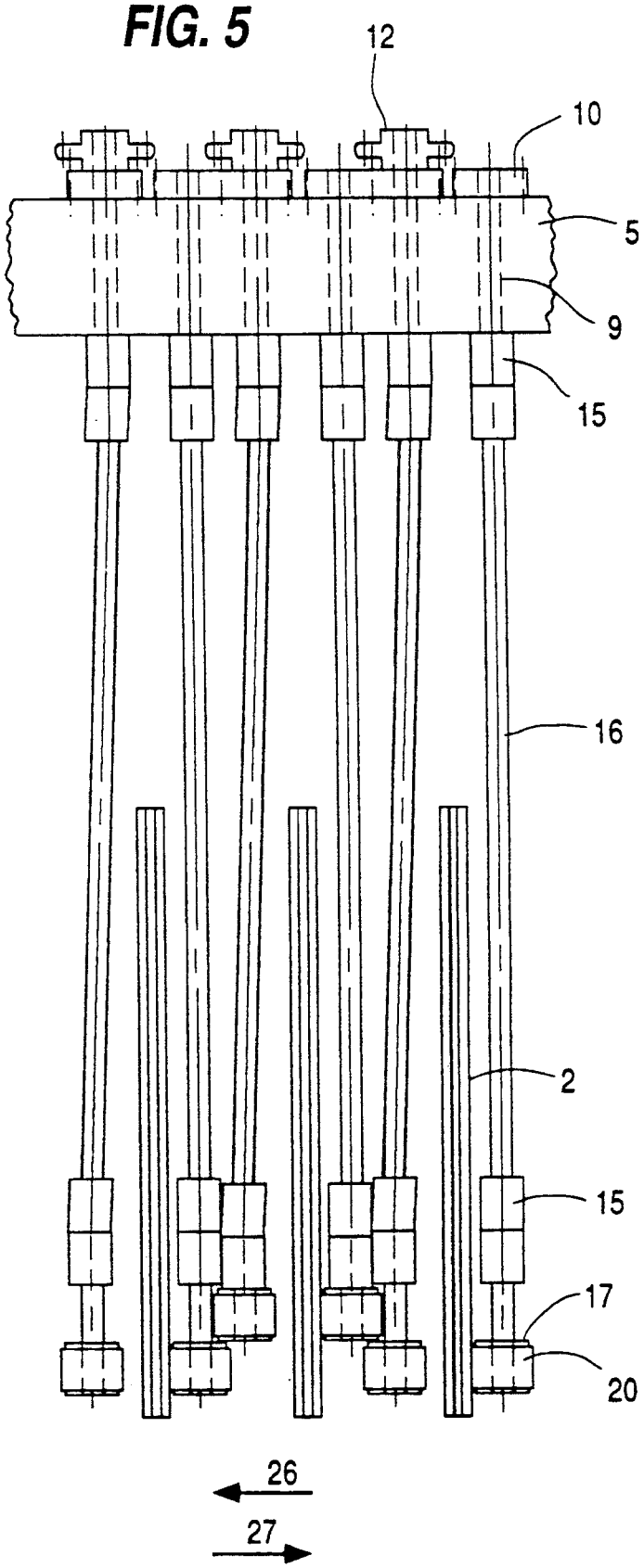
FIG. 5 is a top view of FIG. 3.

A carrier 5 (see FIGS. 3–5) has holders 6 and 7, secured to a guide 8. The holder 5 retains shafts 9 which carry gears 10, to rotate therewith. A chain 11, running over a sprocket 12 (FIGS. 4, 5) is suitably guided by deflection elements, for example deflection rollers or wheels 13. The return run of the chain is supported by a guide 14. FIG. 5, which is a top view of the transport system, shows that the gears 10 mesh, in counter rotation, with each other, and transfer torque via shafts 9, elastic coupling 15 and shaft 16 on gear belt wheels 17. The gear belt wheels 17 are journalled in supports 18 . Further wheels 19 are provided to form run-over wheels for the belts 20.

Figure 3:
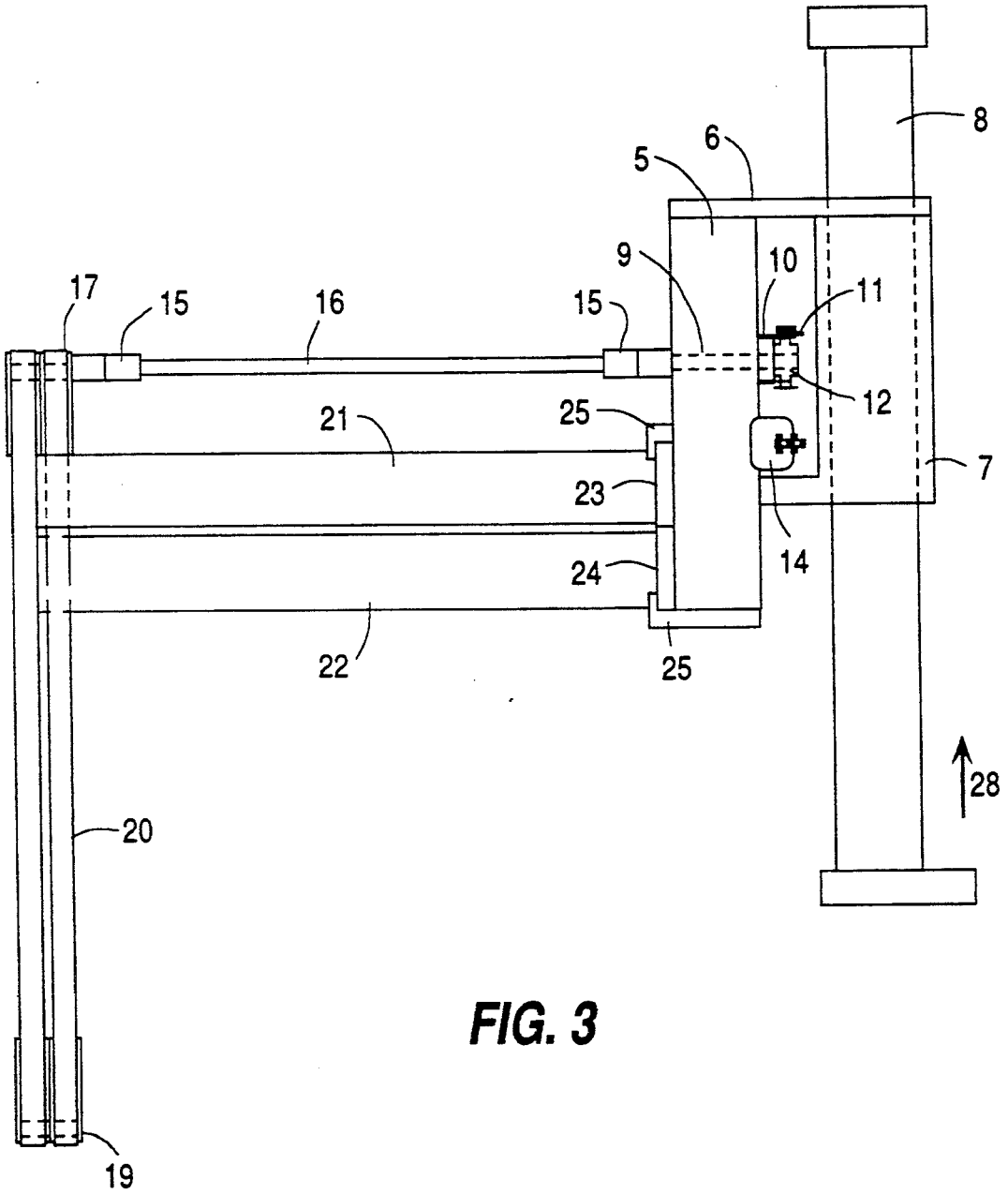
FIG. 3 is a fragmentary and detailed front view of a carrier structure, shown only generally in FIG. 1.

The belts 20 are placed in pairs opposite each other, and run in counter running direction. They are supported by the carriers 18 and holding elements 21, 22 (FIGS. 3, 4). One of the holding elements 21 is fixed or rigid; the other holding element 22 is elastic. Rails 23, 24 are located on the holding element, retained in position in guide 25 on the carrier 5. If the rails 23, 24 are moved in accordance with the arrows 26, 27 (FIG. 4), in counter-moving direction, by a clamping system - not further shown - then the belts 20 are guided in counter-running direction, each, against one of the printed products 2 which is to be transported, thereby clamping the printing product 2 in predetermined position and alignment. This entire transport device or system can be raised by guides 8 (FIG. 3) and a suitable drive in a direction of the arrow 28, so that the belts 20 will then assume the position 20′ (FIG. 1) and grip the printed products 2 (FIG. 1). Since the holder 22 is elastic, the gear belts 20 are elastically engaged, to ensure reliable guidance of the printed products 2.

Upon operation of the drive 29 (FIG. 1), racks 30 move rails 31, and hence the elements 3, in counter direction, that is, respectively, in the direction of the arrows 32, 33, so that they will accept the position 3′ and thus release the printed products 2. Upon start of the drive of the chain 11, the sheets are now moved in the direction of the arrow 34. Single addressing of the printed products can be carried out at this point, for example by any addressing apparatus 35, as well known, e.g. as described in German Patent Document DE-OS 34 05 877. The entire transport unit is moved along the guides 8 in the direction of the arrow 34, that is, downwardly, in order to move the printed products 2 into the position 2′. This movement continues until the lower gear wheel 19 has assumed the position 19′. This permits the printed products 2 to be moved reliably into the position 2′. The printed products are aligned in the direction of the arrows 36, 37, respectively, and arrow 38 against engagement rails 39, which can be adjusted to depend on the size of the printed products or the sheet size. In the position 2′, the printed products are clamped, as will be described below, to be cut or trimmed at an edge parallel to the fold line, for example at the upper edge.

After a first trimming cut, the gear belts 40 of a further transport system, similar to the one just described, will grip the printed products and move them into the position 2″ (FIG. 1). They are aligned by tongues or projections 41 and are clamped at both sides, individually, and then are trimmed at both lateral sides, as will be described below. After release from tongues 41, and movement thereof over rail 43 in the direction of the arrow 42 (FIG. 9), the printed products 2, now cut or trimmed, are stacked and transported by the transport belt 40 via guide tongues 44 to a lower stacking system, described, for example, in the referenced U.S. patent application Ser. No. 07/329,798, filed Mar. 28, 1989, by the inventor hereof.

Figure 8:
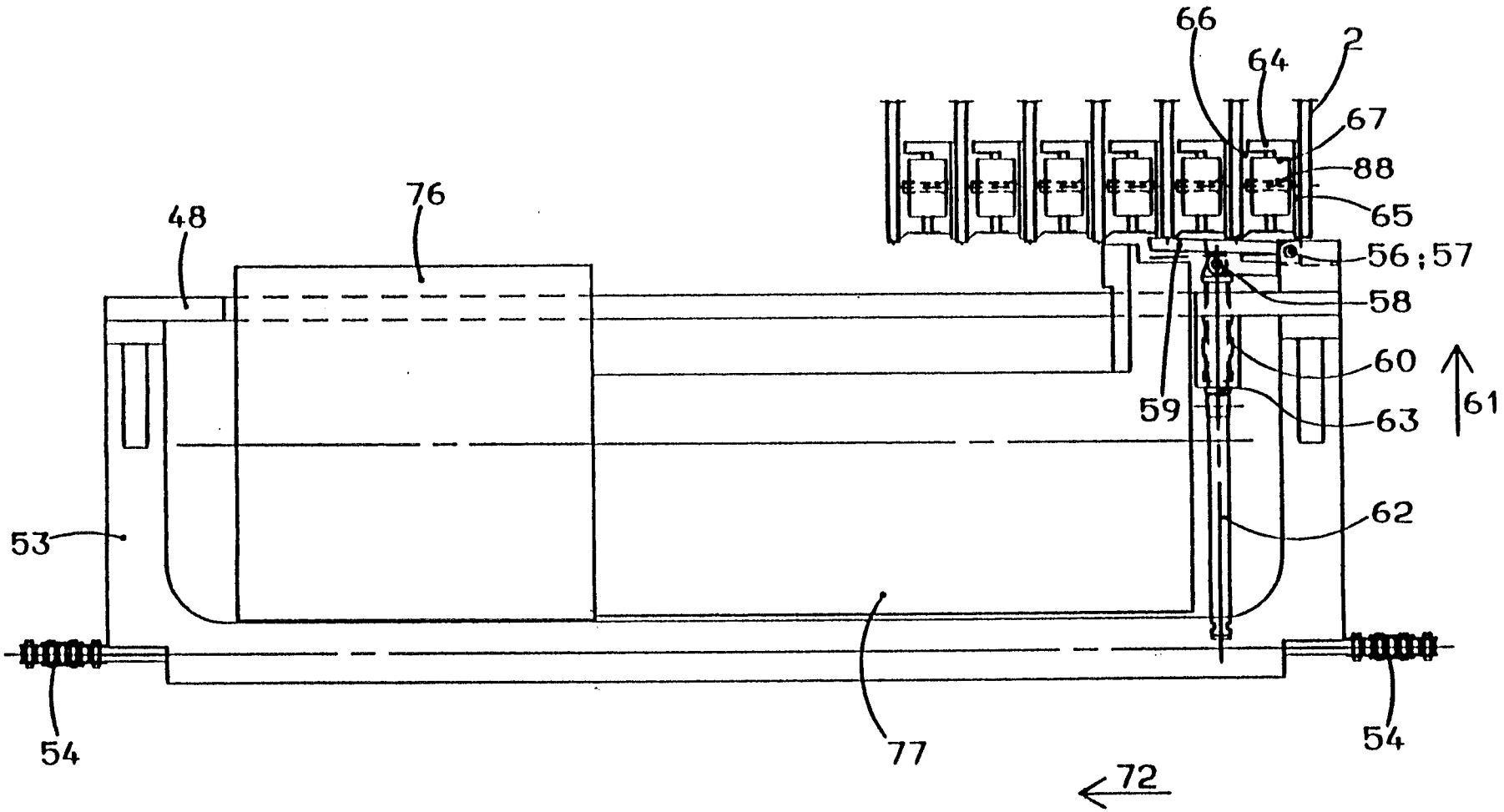
FIG. 8 is a cross-sectional view along the line II—III of FIG. 7 and illustrating the cutter support slide or carrier.
Figure 9:
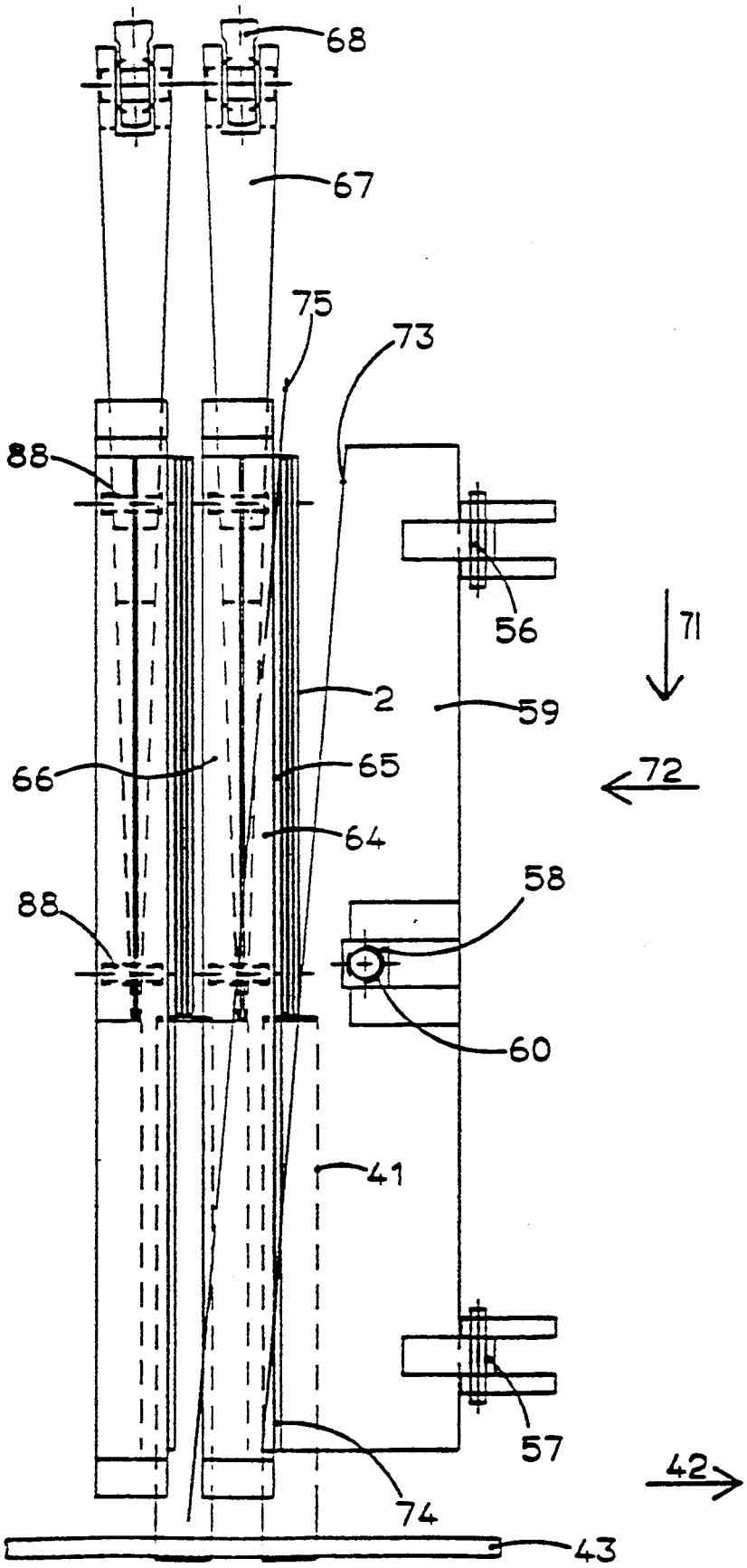
FIG. 9 is a side view of the suspension arrangement for the side cutting knives.
Figure 10:
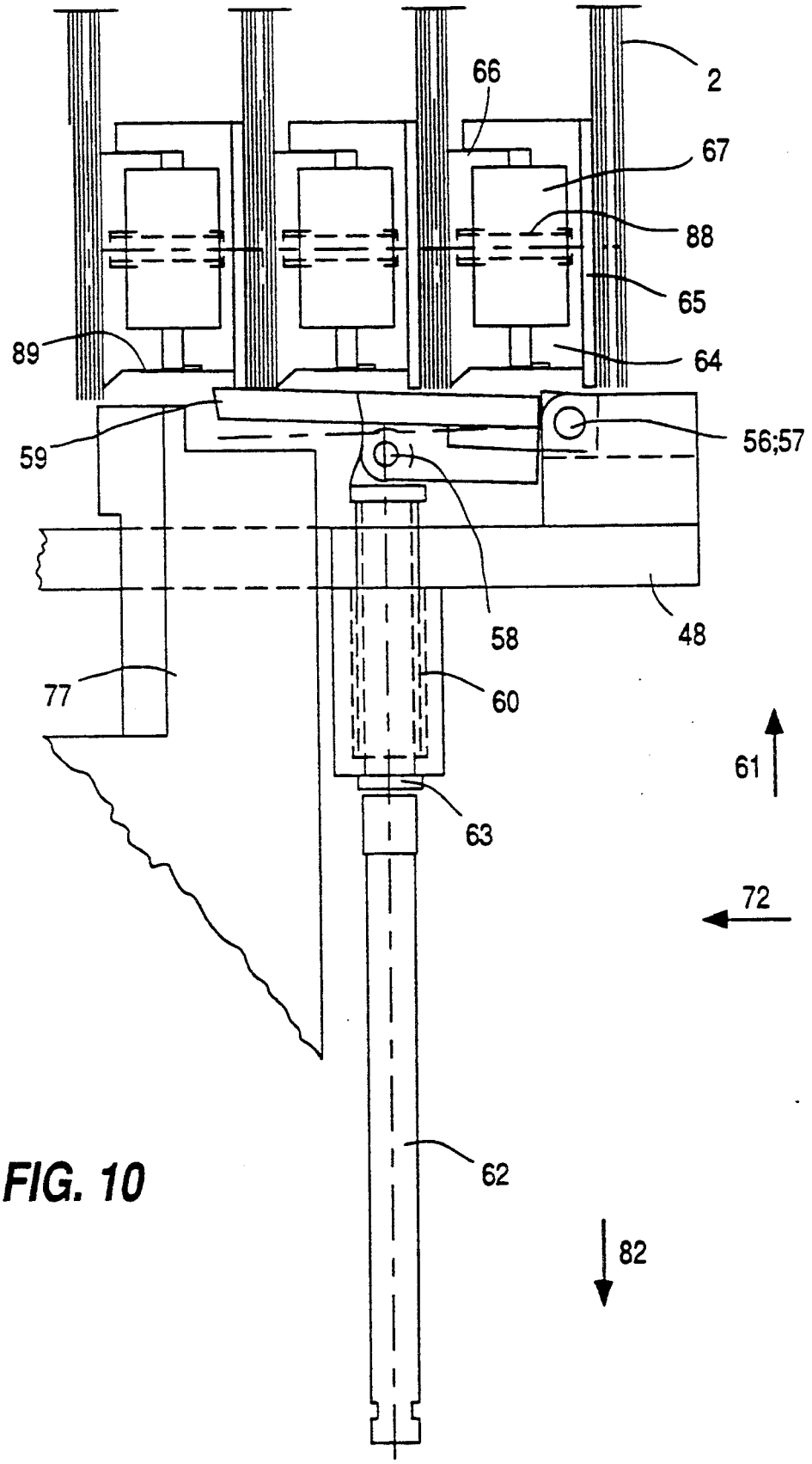
FIG. 10 is a top view illustrating a side cutting operation.
Figure 11:
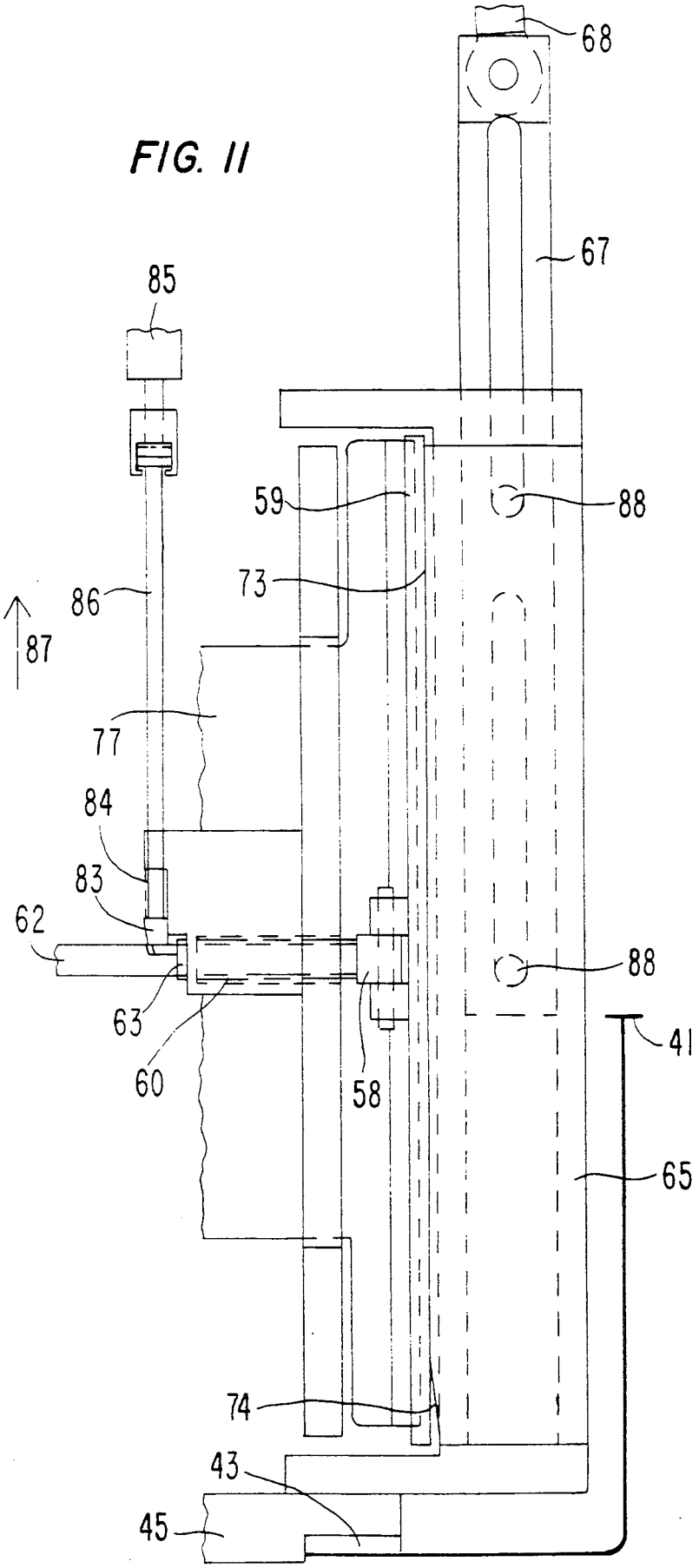
FIG. 11 is an end view of the side cutting slide or carrier and its support arrangement for the side cutting knives.

Clamping arrangement with reference to FIGS. 6–9, and lateral cutting system with reference to FIGS. 9–11

Figure 6:
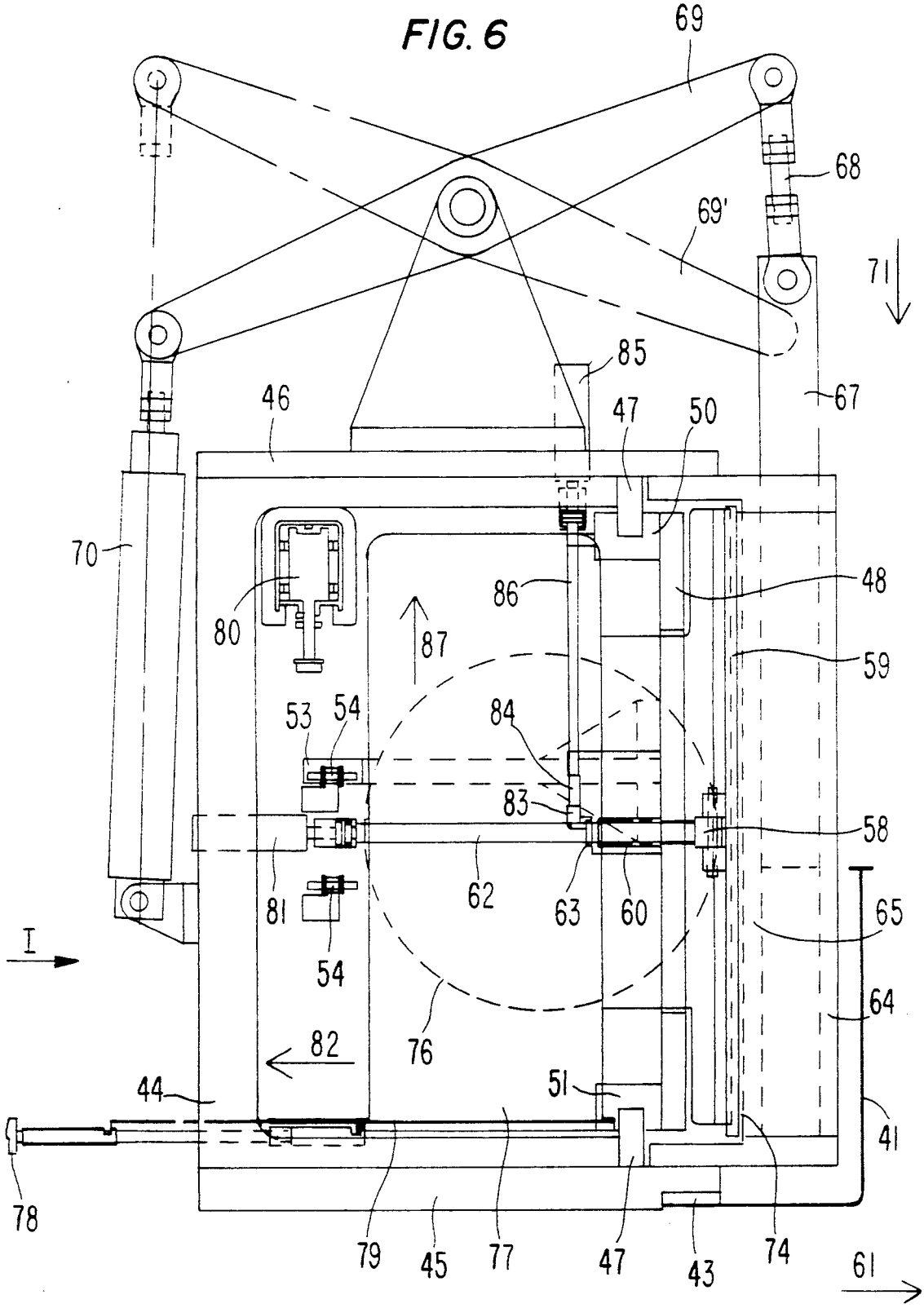
FIG. 6 is a front view of the lateral cutter assembly.
Figure 7:
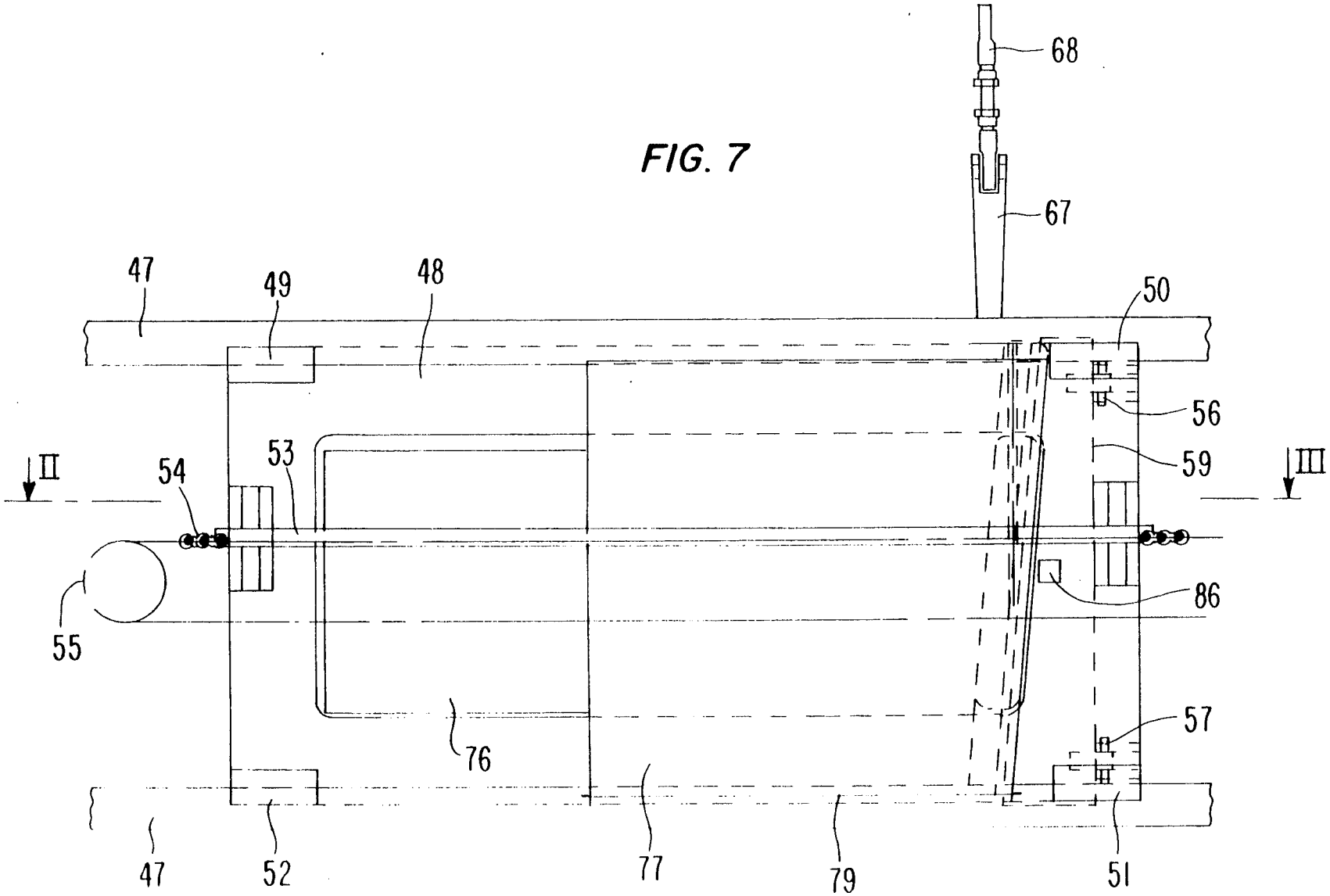
FIG. 7 is a view of FIG. 6 in accordance with the arrow I of FIG. 6.

Carriers 44 (FIG. 6) and plates 45, 46, together, form a carrier frame, continuous in logitudinal direction, which supports guide rails in form of slider rails 47. An upper and lower rail is provided, as seen in FIG. 6. A plate 48, together with glide shoes 49, 50, 51, 52 (FIG. 7) forms a support slide or carrier. The support slide or carrier 48, 49–52 can be driven by a drive 55 coupled to a chain 54, and attached via a support frame 53. The slider 49–52 supports a cutter knife 59, which is suspended on two joints 56, 57, as well as by a joint 58. The joint 58 is supported by a compression spring 60, which acts in the direction of the arrow 61 (FIG. 8). A pull rod 62 has a stop 63.

Each one of the separate printed products 2 is securely clampled by a first clamping assembly which is formed by a fixed portion 64 and a counter knife or counter knife element 65, a movable clamping jaw 66, a wedge 67 and a pivot rod 68 - see FIGS. 8 and 9. A pivot lever 69 and a pneumatic cylinder 70 (FIG. 6) complete the clamping assembly.

As seen, the clamping assembly is secured with the plates 45, 46 by the fixed portion 64.

Operation

The pneumatic cylinder 70 presses the wedge 67 in the direction of the arrow 71 (FIG. 6). The pivot lever 69, in one extreme position, can take up the position 69', and places the wedge 67 its lowest position, with respect to the direction of the arrow 71. In this position, the movable clamping jaw 66 is pressed entirely against the counter or cutting counter element 65. Each one of the clamping units has its own pneumatic cylinder. This arrangement, thus, permits the clamping units simultaneously to clamp a plurality of printed products 2, which may have entirely different thicknesses or different initial dimensions. The wedge 67 presses the clamping jaw 66 throughout its entire length against the respective printed product 2 which, thus, fits flat and snugly against the counter element or cutting counter element 65. In an extreme and limiting position, one clamping unit can accept a printed product 2 having a maximum number of pages, and another clamping unit can clamp, immediately adjacent thereto, a single sheet. Each one of the respective printed units are securely clamped and are cut by the cutting knife to be described in detail below with reference to FIGS. 9–11 to make a clean cut, similar to a scissor cut.

The side cutting arrangement or assembly, shown in FIGS. 9–11, includes the cutter knife 59, which is suspended on the three joints 56, 57, 58. It is moved by the slider or carrier 48 in the direction of the arrow 72 (FIGS. 9, 10). Upon such movement, the inclined cutting edge 73 first engages a bulge 74 (FIG. 9) of the counter knife element 65. The spring 60 (FIG. 10) presses the knife in the direction of the arrow 61. FIG. 9 illustrates the position in which the knife has already passed the bulge 74, so that it starts cutting the printed product 2 with its cutting edge. The cut is terminated when the cutting edge 73 has reached the line 75. Only then can it be re-aligned by the bulge 74 of the next counter element 65. The stop 63 (FIG. 10) prevents the knife from dropping down, in the direction of the arrow 61, to a point which is too low.

Cutting is facilitated by the slightly inclined position of the knife 59, see FIG. 10. One of the components of the cutting force thus acts in the direction of the arrow 61 and supports the resilient force exerted by the spring 60.

When cutting printed products, and particularly when cutting individual printed products which may have widely varying page or sheet numbers, it is of importance to remove the cut slivers or strips or scrap material. In accordance with a feature of the invention, cut-off scrap is continuously removed by a suction system 76 (FIGS. 7, 8) secured to the slider or carrier of the knife. The pneumatic suction system 76 transports the cut scrap into a container 77 which is emptied when the knife slider or carrier has reached its final position. Removal of the cut scrap is done by opening a slider 79 by a pneumatic cylinder 78 (FIG. 1) for removal of scrap material in the direction of the arrow 72, so that the sucked-away scrap can then drop into a suitable container for final removal. A current supply bus way 80 provides electrical supply for the suction apparatus 76. Electrical slide contacts connect the suction system 76 with exposed conductors of the bus way 80.

When the knife slider or carrier 48 has reached its final position, the cutter knife 59 is raised by the lifting rod 62 (FIG. 8) counter the force of the spring 60, upon operation of a further stationary pneumatic cylinder 81, to raise the knife in the direction of the arrow 82. In this raised position, a latch 83, spring-loaded by a spring 84, locks the knife. When the sliding door 79 of the removal container 77 has closed, the knife slider or carrier can be returned in a fast return movement counter the cutting direction, that is, counter arrow 72 (FIG. 9), in its or starting position. In the starting position, the rod 62 is unlatched by pull on a pull rod 86, operated by a further stationary pneumatic cylinder 85 (FIG. 6), to effect release movement in the direction of the arrow 87, and permit return of the cutting knife 59 in its initial inclined cutting position.

Movement of the clamping wedges 67 counter the direction of the arrow 71 (FIGS. 6, 9) releases, simultaneously, all the clamping units, and all the movable clamping jaws 65 and 113, which are returned by springs 88 (FIG. 9) into their initial position. Seals 89 (FIG. 10) prevent cutting scrap from falling into the clamping arrangements.

The entire cutting assembly, as generally shown in FIG. 6, can be shifted in the direction of the arrow 61, or counter the direction of the arrow 61, respectively, to fit the width of the printed product 2. Two such cutting knife suspension systems and cutting knives 59 are provided, so that both the right and left sides of all of the printed products can be trimmed in one knife operating cycle, with the cutting width for the printed product being adjustable by shifting the respective cutting units, as shown in FIG. 6, in the direction of the arrow 61 or counter the arrow 61.

Figure 12:
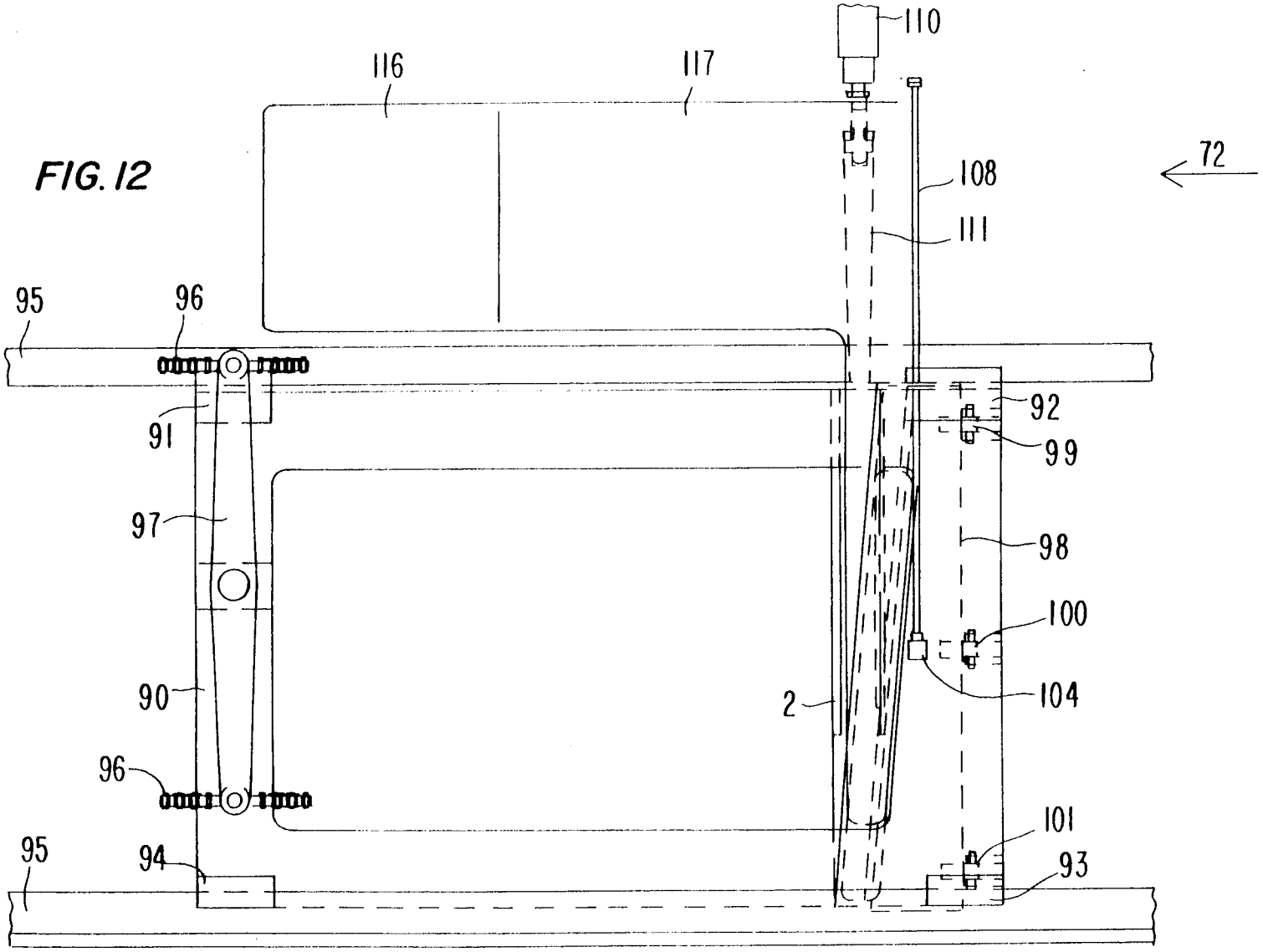
FIG. 12 is a front view of the slide or carrier for the knife making the first cut parallel to the fold of a folded product.
Figure 13:
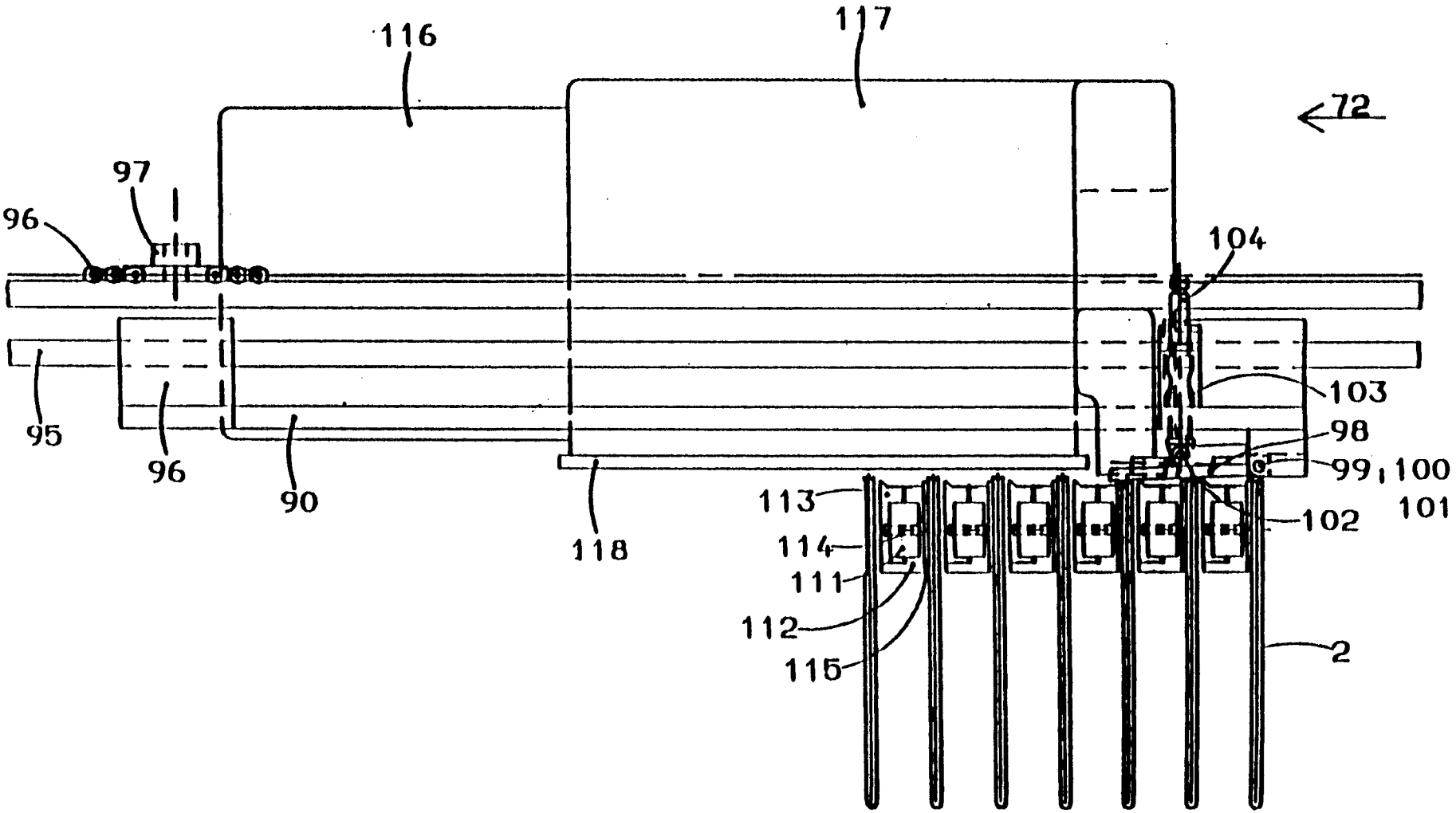
FIG. 13 is a top view of the system of FIG. 12.
Figure 14:
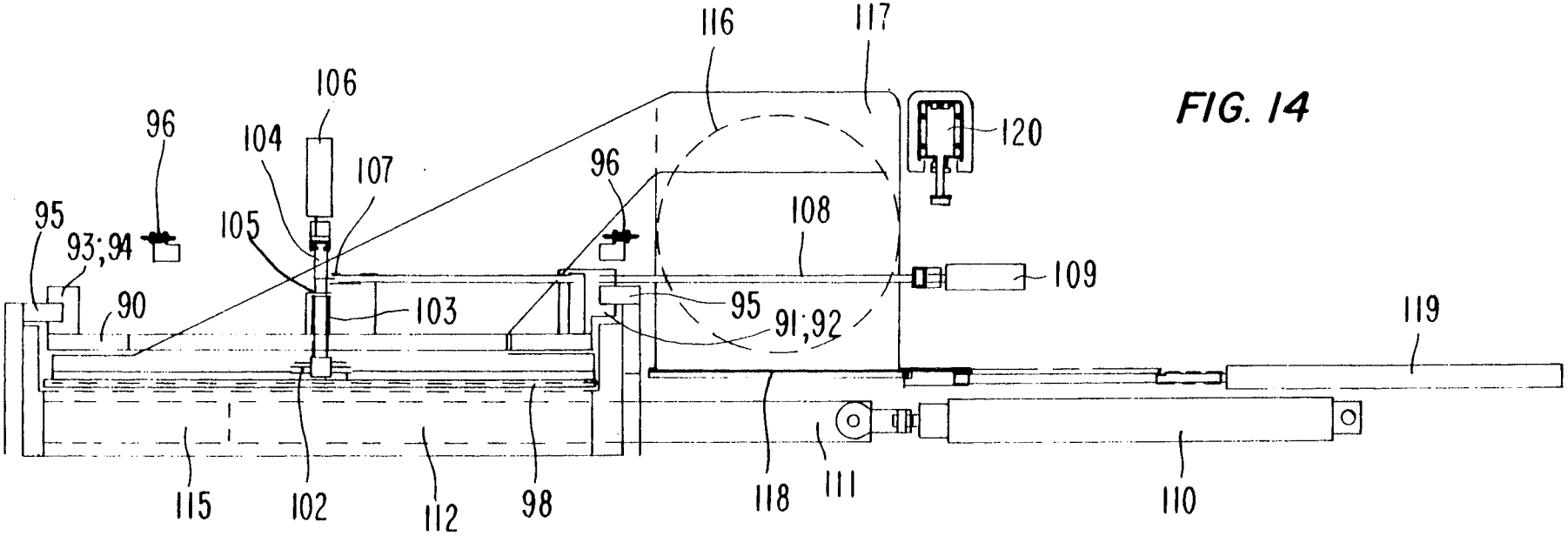
FIG. 14 is a top view of the system of FIGS. 12 and 13.

End cutting arrangement, with reference to FIGS. 12–14

In general, the operation of the cutting arrangement to cut or trim the end of the printed product, typically the end opposite a folded line of a folded product, is generally similar to that previously described with respect to the side cutting arrangement. The knife slider or carrier is formed by a plate 90, to which slide shoes 90–94 are secured, running on slide rails 95. The knife support carrier or slider 90, 91–94 is operated by chains 96, connected to a lever 97, and pulling the knife in the cutting direction of the arrow 72. A cutter knife 98 is suspended on joints or links 99, 100, 101, 102 (FIG. 13). A compression spring 103 engages a pull rod 104 which is secured to a joint or link 109, and presses the rod 104 against a stop or abutment 105.

After cutting, and in the terminal position of the knife support slider or carrier, rod 104 is raised by a stationary pneumatic cylinder 106 and locked by a lock or latch 107, so that the knife carrier or slider can be returned to its initial position by a rapid return movement. The latch 107 is then unlocked by a pull rod 108, operated by a stationary pneumatic cylinder 109, so that the cutter knife 98 is again placed into cutting position. The pneumatic cylinder 110 operates the clamping units for each one of the printed products 2. The clamping elements are formed by clamping wedges 111, a fixed clamping jaw 112, and a movable clamping jaw 113 and springs 114. The fixed jaws 112, at their lower region, carry a bulged cutting counter element 115. The cutting operation is the same as that described in connection with the lateral cuts.

A suction system 116 removes the cut scrap. Suction system 116 is mounted on or secured by the knife slider or carrier 90. When the knife has reached the final position after having made all the cuts, a sliding door 118 of the receiver 117 is opened by a stationary pneumatic cylinder 119, and then again closed. The suction system 116 receives electrical current from a slider bus 120.

The upper cutting system is non-adjustable, in contrast to the shiftable position of the lateral cutting arrangements. Matching the position of the cut to the required format is obtained by setting of the abutment rails 39 (FIG. 1).

Various changes and modifications may be made, and any features described herein may be used with any of the others, within the scope of the inventive concept.

I claim:

1. Cutter system for cutting three sides of a plurality of folded printed products (2) defining a fold line or crease, or back, comprising a first cutting assembly for cutting a first side of the products opposite said fold line or crease, including a plurality of individual retention means (112, 113), each one retaining at least one of said products (2) in a first cutting position and in predetermined alignment;

a first cutting knife means (98) and a first cutting counter means (115);

first guide means (95);

first support slide or carrier means (90) supporting said first cutting knife means (98) and movable on said first guide means (95);

a knife operating means (54, 72, 96);

said first guide means being located to guide said cutting knife means, upon being operated by said operating means past said first cutting counter means (115) so that, upon movement of said cutting knife means (98) past the first side opposite the fold line or crease of the printed products, said first side will be cut;

a second cutting assembly for cutting two lateral sides of said plurality of folded products, said two lateral sides being transverse to said first side of the printed products;

transfer means (8, 20, 21, 22, 28; 11, 34, 40) moving said plurality of folded printed products between said first cutting assembly and said second cutting assembly while maintaining said predetermined alignment of said products;

a plurality of second individual retention means (64, 66), each one retaining at least one of said products (2) in a second cutting position, while maintaining said predetermined alignment;

second cutting knife means (59) and second cutting counter means (65);

second guide means (47);

second support slide or carrier means (48) supporting said second cutting knife means (59), and operatively associated with said operating means (96) and movable on said second guide means (47), said second guide means being located to guide said second cutting knife means past said second cutting counter means so that, upon movement of said second cutting knife means past said printed products, two further sides thereof will be cut;

wherein said first individual retention means (112, 113) and said second individual retention means (64, 66) each include a fixed clamping jaw (112, 64) and a movable clamping jaw (113, 65); and wherein movable means (67, 111) are provided, operatively associated with the movable clamping jaws to clamp the movable clamping jaws towards the fixed clamping jaws and positively retain the printed products between the movable and fixed clamping jaws.

2. The system of claim 1, wherein said movable means comprise movable wedges (67, 111), to clamp the movable clamping jaws towards the fixed clamping jaws, and positively retain the printed products between the movable and fixed clamping jaws.

3. The system of claim 2, further including pneumatic piston means (110, 70) coupled to said movable wedges (111, 67) to shift said movable wedges.

4. The system of claim 3, further including double lever means (69) coupled, respectively, to the pneumatic piston means (110, 70) and said wedges (111, 67) for selectively engaging the movable clamping jaw (66) against the fixed clamping jaw (64), with a printed product therebetween.

5. The system of claim 1, further including knife disengagement means comprising knife lifting means (104; 81, 82, 83, 84) lifting the cutting knife means (98, 59) off the cutting counter means (115, 165), and including means for rapid return of said cutting knife means (98, 59) to a starting position for cutting further pluralities of printed products.

6. The system of claim 1, further including product supply means for supplying said produces to said first cutting assembly, said product supply means including a pair of ribbed or gear belts (20) and supplying said plurality of printed products, individually, to said first individual retention means.

7. The system of claim 6, in combination with a zigzag storage means (3), said ribbed or gear belts (20) removing said printed products from said storage means for supply to said first individual retention means.

8. The system of claim 6, further including gear means (17) in engagement with said ribbed or gear belts (20);

drive shafts driven by a drive source; and elastic couplings (15) coupled to said drive shafts, said pairs of ribbed or gear belts being deflectable to, selectively, grip and release said printed products.

9. The system of claim 6, further including a fixed support means (21);

an elastic support means (22) and a belt support (5), said ribbed or gear belt pairs (20) are supported from said belt support (5) via said fixed and elastic support means (21, 22);

and guide means (8) for shifting said belt support (5).

10. The system of claim 1, wherein said first support slide or carrier means (90) comprises a first plate element (90);

said second support or carrier means comprises a second plate element (48);

said first and second cutting knife means (98, 59) being, respectively, movably secured to the respective plate elements;

wherein said first cutting counter means (115) and said second cutting counter means (65), each, are formed with a bulge (78), said respective cutting knife means (98, 59) being moved to engage against said bulge;

and wherein resilient means are provided coupling the respective cutting knife means (98, 59) to the respective plate element (90, 48).

11. The system of claim 1, further including at least one suction apparatus (116, 76) movable with at least one of said cutting knife means (98, 59).

12. The system of claim 11, wherein said suction apparatus (116, 76) includes a receiver (117);

a selectively opening door (118) and stationary pneumatic operating means (119) engageable with said door when said receiver (117) is at a terminal position of said cutting knife means (98, 59) for opening the door and emptying the receiver.

13. The system of claim 1, wherein said second retention means (64, 66) and said second cutting knife means (59) and cutting counter means (65) are laterally shiftable to permit adjustment of the cutting width of the printed product.

14. The system of claim 13, further including an abutment or support rail (39) positioned in the path of the printed products to locate the printed products in a predetermined height position to control and adjust a cutting operation line of said first cutting knife means (98) and hence the height or length of the cutting line of the printed product.

15. The system of claim 1, further including guide tongue means (44) for guiding said printed products (2) after having been trimmed or cut at three sides thereof, said guide tongue means guiding said trimmed or cut printed products to a removal device.

* * * * *